US006587401B2

(12) United States Patent
Rebeaud et al.

(10) Patent No.: US 6,587,401 B2
(45) Date of Patent: Jul. 1, 2003

(54) ANTI-SHOCK TRANSMISSION DEVICE FOR DRIVING A GENERATOR BY AN OSCILLATING WEIGHT IN PARTICULAR IN A WATCH

(75) Inventors: Jean-Philippe Rebeaud, Cressier (CH); Denis Burdet, Neuchâtel (CH)

(73) Assignee: ETA SA Fabriques d'Ebauches, Grenchen (CH)

( * ) Notice: Subject to any disclaimer, the term of this patent is extended or adjusted under 35 U.S.C. 154(b) by 45 days.

(21) Appl. No.: 09/987,997

(22) Filed: Nov. 16, 2001

(65) Prior Publication Data

US 2002/0071348 A1 Jun. 13, 2002

(30) Foreign Application Priority Data

Dec. 7, 2000 (EP) ..... 00204370

(51) Int. Cl.[7] ..... G04B 1/08; G04B 1/10

(52) U.S. Cl. ..... 368/204; 368/140; 368/144

(58) Field of Search ..... 368/143, 140, 368/144, 203, 204, 206, 207, 208; 310/36–37, 75 A; 185/37, 45; 318/119, 131; 322/3; 267/195, 199

(56) References Cited

U.S. PATENT DOCUMENTS 1,276,456 A * 8/1918 Vasselli ..... 185/45
2,721,627 A * 10/1955 Wittel ..... 185/45
3,999,369 A * 12/1976 de Valroger et al. ..... 368/204
5,923,619 A * 7/1999 Knapen et al. ..... 368/64
6,061,289 A 1/2000 Kaelin

FOREIGN PATENT DOCUMENTS

| | | |
|---|---|---|
| EP | 681228 | 11/1995 |
| EP | 791867 | 8/1997 |
| GB | 662226 | 12/1951 |

* cited by examiner

*Primary Examiner*—David Martin
*Assistant Examiner*—Michael L. Lindinger
(74) *Attorney, Agent, or Firm*—Sughrue Mion, PLLC

(57) ABSTRACT

The transmission device disclosed is inserted between a rotating oscillating weight and an electric micro-generator in order to drive the generator rotor from the oscillating weight by multiplying the rotational speed. Its intermediate wheel and pinion includes a barrel (27) whose central shaft (24) is coupled to the drum (41) of the barrel by a spiral spring (30). The inner end of the spring has a bent portion (34) which engages via resilience in any one of a number of hollows (51) in the shaft and can be released by sliding over a slanting side (52) when the shaft exerts too great a torque in the given rotational direction. This arrangement prevents damage resulting from shocks, in particular in the case of a watch, without using a friction system.

12 Claims, 2 Drawing Sheets

ANTI-SHOCK TRANSMISSION DEVICE FOR DRIVING A GENERATOR BY AN OSCILLATING WEIGHT IN PARTICULAR IN A WATCH

The present invention concerns an anti-shock transmission device for driving a rotor of an electric generator by an oscillating weight in a portable apparatus, including a central shaft and an intermediate toothed wheel, one of which is capable of being driven in rotation by movements of the oscillating weight and the other of which is coupled to the generator rotor by a kinematic connection, the central shaft and the intermediate wheel having a common axis of rotation, and a spiral-shaped spring having an inner end coupled to the central shaft and an outer end coupled to the intermediate wheel. The invention also concerns a wristwatch including an electric generator driven by an oscillating weight via such a transmission device.

Such a device can be used in particular in an apparatus of small volume worn by a user whose movements will cause the oscillating weight to swing, usually in rotation. It may be, for example, but in a non-limiting manner, a wristwatch whose watch movement and/or other operating elements are powered by an energy accumulator charged by the electric generator. Since the oscillating weight generally rotates at quite a low speed in normal operation, and the generator rotor has to rotate at a high speed to generate sufficient electric voltage, a multiplying transmission between these elements needs to be used. In cases where the generator rotor includes a single permanent magnet rotating about itself, the necessary transmission ratio is of the order of 100 and it is usually obtained by means of a two stage gear transmission.

Such an arrangement may undergo damage in the event of shock caused for example by the apparatus being accidentally dropped and generating a very high acceleration of the oscillating weight. Despite the small mass of the rotor and the second transmission stage, their inertial creates a not negligible resistant torque because of the high transmission ratio. Such a shock may also permanently damage the transmission or the generator. This is why various anti-shock devices have been proposed for a transmission of this nature.

European Patent No. 0 326 312 proposes a friction transmission between the oscillating weight and the electric generator rotor. The friction is calculated so that the wheel of an intermediate wheel and pinion skids on its shaft when the torque to be transmitted exceeds an admissible value. However, with such a friction device the limit torque value may vary considerably, on the one hand because of the difficulty in obtaining a friction of constant value in large scale manufacturing, and on the other hand because of inevitable variations in friction conditions during use.

European Patent No. 0 791 867 proposes a transmission device of the type indicated in the preamble hereinbefore. In an embodiment illustrated by FIGS. 16 to 18 of the document cited, the inner end of a flat spiral-shaped spring is rigidly fixed to the central shaft driven by the oscillating weight, while its outer end is rigidly fixed to the intermediate wheel which is meshed with the pinion of the generator rotor. The spring has sufficient rigidity to undergo practically no deformation in normal operation. When the oscillating weight is driven slightly more than normal, for example when a watch worn on the wrist is moved abruptly, the spring can be sufficiently deformed to avoid damage to the gears. When there is a more significant acceleration of the oscillating weight, for example if the watch falls to the ground, the spiral spring fastenings are likely to resist.

However, the stress which the spiral spring itself undergoes is likely to lead to irreversible deformation or breakage of the spring or its attachments.

The object of the present invention is to perfect an anti-shock transmission device of this type, while avoiding using friction damping and creating a simple inexpensive structure which avoids breaking the spring or its attachment when the apparatus undergoes a shock of a certain amplitude, for example (but in a non limiting manner), up to the value of 5,000 g prescribed by the ISO 1413 standard.

The invention thus concerns an anti-shock transmission device of the type indicated in the preamble, characterised in that the central shaft includes a series of hollows distributed over its periphery and in that the inner end of the spring is arranged to engage in anyone of said hollows via the resilience of the spring and to be able to be released from the hollow when it is subjected to sufficient force in at least one rotational direction of the device.

It may thus be considered that the inner end is coupled to the central shaft by a click mechanism, owing to the spring's own resilience, this click mechanism being able to be released when the rotation of the shaft in one direction has pushed back the turns of the spring sufficiently outwards for the spring to be no longer able to keep its inner end in the hollow where it was meshed. This end forming a kind of click will then jump out of the hollow to then engage again in the next hollow, as soon as conditions allow. In order to facilitate the release of the end of the spring, each hollow may preferably include a slanting side and the inner end of the spring may include a part which projects inwards, and is able to abut against said slanting side to receive said force and slide over it until said force exceeds a limit value.

Other features and advantages of the invention will appear in the following description of a preferred embodiment, given by way of non limiting example with reference to the annexed drawings, in which.

Figure 1:
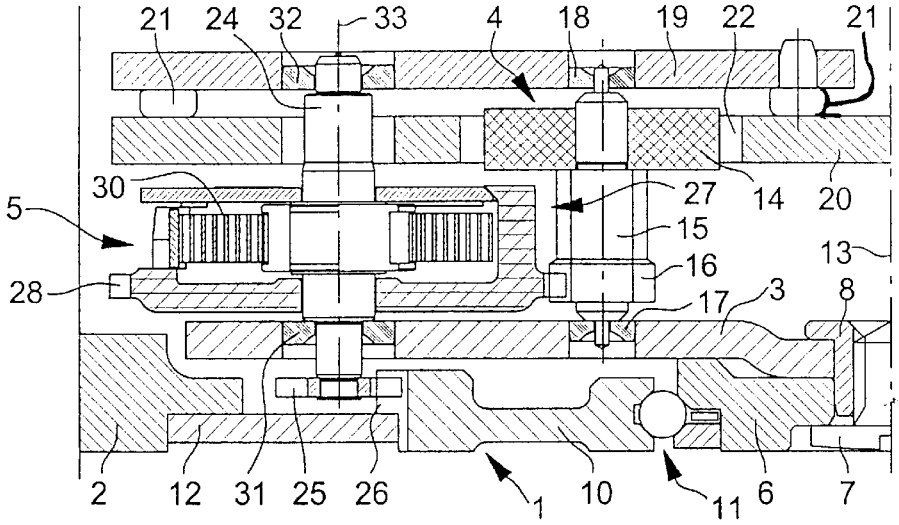
FIG. 1 is a vertical cross-section of an electric generator assembly for a watch, wherein an anti-shock transmission device according to the invention is inserted between an oscillating weight mechanism and an electric micro-generator.

As can be seen in FIG. 1, a mechanism 1 with a rotating oscillating weight 2, mounted on a plate 3 of the watch movement, drives in rotation the rotor 4 of an electric micro-generator via an anti-shock transmission device 5 which multiplies the rotational speed.

Mechanism 1 is constructed in a conventional manner. Its central bearing support 6, fixed to plate 3 by means of a screw 7 and a tubular nut 8, supports a toothed wheel 10 via a ball bearing 11. The semi-circular oscillating weight 2 is fixed to toothed wheel 10 via a ring 12 and can rotate around central shaft 13 of the watch.

Rotor 4 of the generator thus includes a permanent magnet 14 fixed onto an shaft 15 provided with a pinion 16. The pivots at the end of shaft 15 are mounted by respective jewels 17 and 18 in plate 3 and in a bridge 19 which is fixed to stator 20 of the generator by means of feet 21. Rotor magnet 14 rotates in a recess 22 of the stator.

Transmission device 5 carries a central shaft 24 which is provided with a pinion 25 and which meshes on toothing 26 of wheel 10, an intermediate wheel formed by a barrel 27 provided with an outer toothing 28 which meshes on pinion 16 of rotor 4, and a spiral spring 30 which connects shaft 24 and barrel 27 in rotation in a resilient manner. Shaft 24 is rotatably mounted in plate 3 and bridge 19 owing to respective jewels 31 and 32 to rotate around an axis 33.

Figure 3:
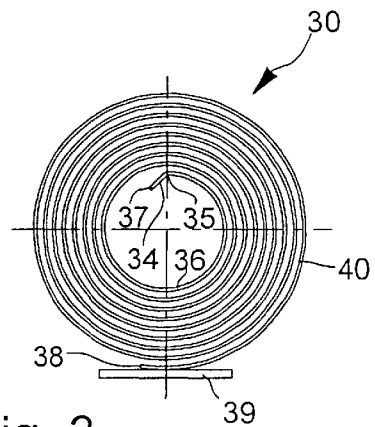
FIG. 3 shows the spring in the idle state.

Barrel 27 will be described in more detail with reference to FIGS. 2 to 6. FIG. 3 shows the shape of spiral spring 30 in the idle state, before it is mounted in barrel 27. Its inner end has a bent portion 34 forming an obtuse angle 35 of approximately 135° with the adjacent portion of the first inner turn 36 of the spring. Bent portion 34 has a free end 37. The spring's outer end 38 is welded to an anchoring plate 39. In this example, spring 30 is formed of a steel strip with a section of 0.04 mm×0.5 mm and when idle, between its two ends, has 8.5 turns which are separated from each other by a gap. When idle, the diameter of inner turn 36 is approximately 1.3 mm and the diameter of outer turn 40 is approximately 3.4 mm. It will be noted that spiral springs of this type are generally manufactured in groups of three to obtain the desired gap between the idle turns. The springs are shaped by rolling the three corresponding strips around a chuck provided with three clamps for holding the inner ends of the springs, then by removing inner stress by a heat treatment. This method automatically creates bent portion 34 at the end of each spring, i.e. no additional operation is required to obtain this end shape.

Figure 4:
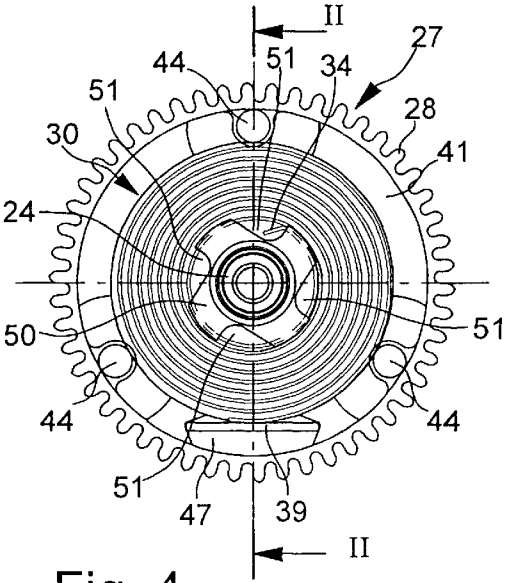
FIG. 4 is a plan view of the object of FIG. 2, after the barrel cover has been removed, and shows the transmission device in a balanced position.
Figure 2:
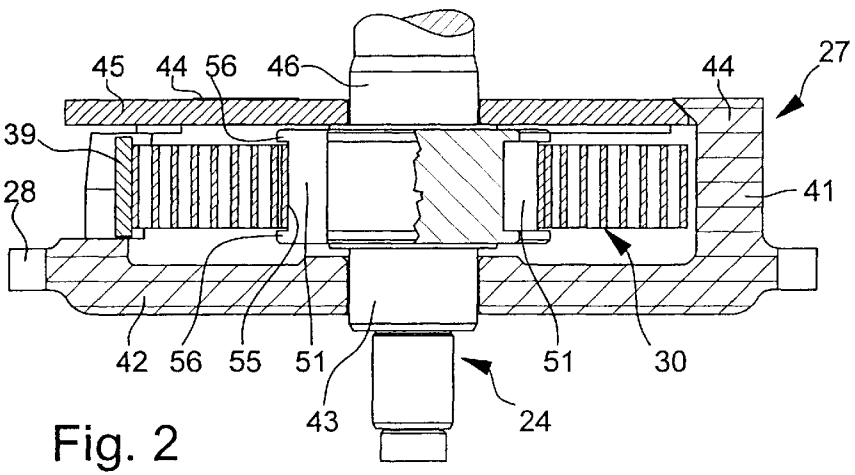
FIG. 2 is an enlarged cross-section of the transmission device, along the line II—II of FIG. 4.

With reference to FIGS. 2 and 4, it can be seen that barrel 27 includes a moulded plastic part including a cylindrical drum 41, a flat bottom 42 which pivots around a cylindrical shoulder 43 of shaft 24, toothing 28 on the periphery of barrel 41 and three feet 44 used to fix a cover 45 which constitutes the upper face of the barrel and which pivots around a shoulder 46 of shaft 24. The cover has been omitted from FIGS. 5 and 6 to allow the inside of the barrel to be seen. Anchoring plate 39 of spring 30 is locked in a recess 47 of drum 41.

Inside barrel 27, central shaft 24 has an enlarged portion 50 provided with a series of hollows 51 distributed on its periphery. In the present example, four hollows 51 are provided, with, in a perpendicular plane to shaft 24, a substantially V-shaped asymmetrical profile whose longest branch forms a slanting side 52 (FIG. 5), while its other side 53 extends approximately radially as far as an edge 54 of the hollow. Between hollows 51, spring 30 can rest on arcuate bearing surfaces 55 which are edged with two rims 56 (FIG. 2) to guide the spring. The diameter defined by shoulders 55 is slightly greater than that of first turn 36 of the idle spring, so that the resilience of the spring tends to engage its bent end 34 in any one of hollows 51 and to clamp first turn 36 slightly onto bearing surfaces 55 of the shaft.

When the watch is not being moved, oscillating weight 2 is stopped and transmission device 5 does not transmit any torque to generator rotor 4, except perhaps a slight positioning torque for magnet 14 with respect to stator 20. Device 5 is then in the balanced position shown in FIG. 4. When a movement is imposed on the watch, oscillating weight 2 begins to rotate in any direction and drives shaft 24 in rotation via toothing 26 and pinion 25. Spring 30 is then taut and transmits torque to barrel 27, which then also begins to rotate and drive rotor 4 in quick rotation via toothing 28 and pinion 16.

Figure 7:
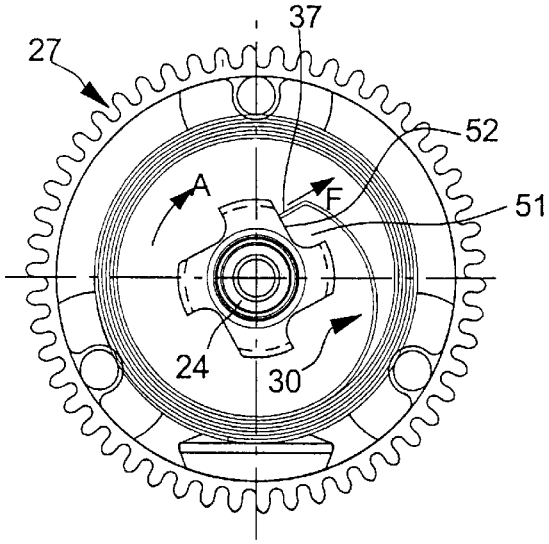
FIGS. 7 and 8 are similar views to FIG. 5 and illustrate the operation of the transmission device when the maximum torque in the first direction tends to be exceeded.
Figure 8:
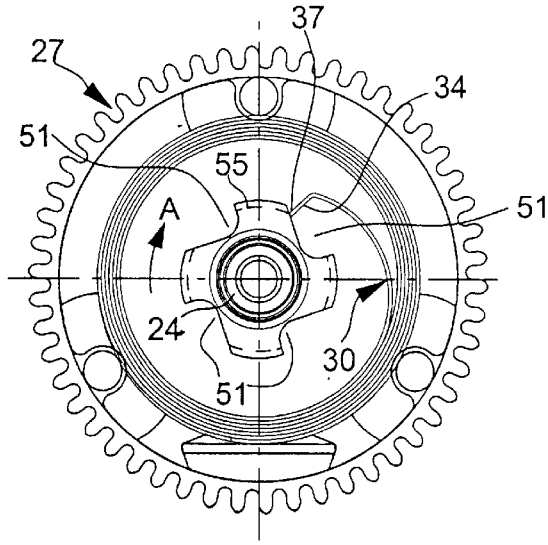
Figure 5:
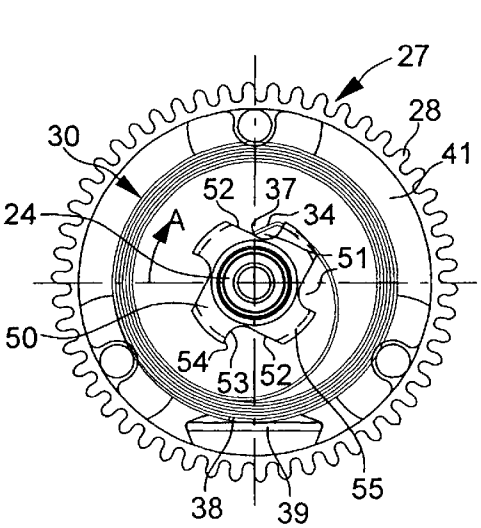
FIG. 5 is a similar view to FIG. 4 and shows the transmission device when it its transmitting a maximum torque in a first direction.

When shaft 24 applies torque to spring 30 in a first direction represented by arrow A in FIGS. 5, 7 and 8, the spring turns increase in diameter until they are successively applied against drum 41 of the barrel, if the resistant generator torque is sufficient. In practice, the end position of the spring, which is shown in FIG. 5 and in which all the turns, except part of the first one, are applied against drum 41, can only be reached during a very high acceleration of oscillating weight 2, for example because of a shock to the watch. This position corresponds to a maximum torque which spring 30 can transmit in direction A. Free end 37 of the spring then abuts against slanting side 52 of hollow 51.

If the torque exerted by shaft 24 still tends to increase, the device reaches the position shown in FIG. 7, where slanting side 52 exerts a force F, approximately perpendicular to side 52, on end 37 of the spring. If force F exceeds a certain limit able to push back end 37 outwards, the latter slides on slanting side 52 in the direction of the exterior and slips out of the hollow from the position of FIG. 8, so that the spring and the barrel rotate more slowly than the shaft. Owing to the spring's resilience, end 37 of the spring will tend to automatically engage in one of the following hollows 51 and remain engaged therein to transmit torque to the spring again when dynamic conditions allow. Automatic uncoupling of the transmission device is thus obtained as soon as the torque reaches a value which exceeds the spring's capacity to deform by expanding into the barrel, which allows damage to be prevented not only to the spring 30, but also to the toothings and bearings of the different wheel and pinions. Moreover, coupling is automatically re-established and allows the device to operate normally thereafter.

Figure 6:
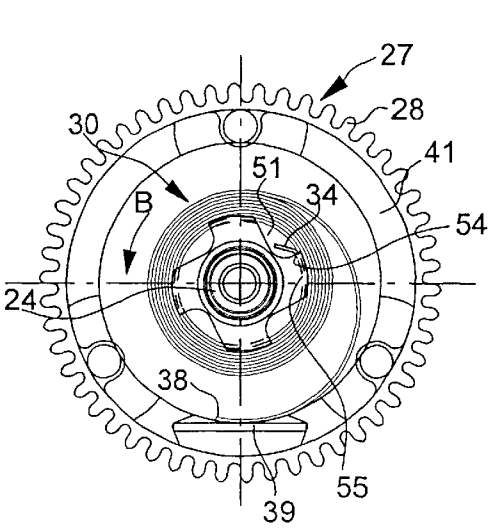
FIG. 6 is a similar view to FIG. 4 and shows the transmission device when it is transmitting a maximum torque in the opposite direction.

When oscillating weight 2 rotates in the other direction, it drives shaft 24 in the direction of arrow B of FIG. 6, so that the torque transmitted tends to clamp the turns of spring 30 in succession onto enlarged part 50 of the shaft. Such clamping keeps bent part 34 of the spring in hollow 51 where it is engaged. Angle 35 of the spring then rests on edge 54 of the hollow.

FIG. 6 shows a situation in which the value of the torque applied by shaft 24 to the spring in direction B is so high that all the turns are applied against the shaft, except the end portion of the outer turn. The absolute value of this torque is substantially the same as in the case illustrated in FIG. 5, but the force resulting therefrom between outer end 38 of the spring and anchoring plate 39 is only a fraction of the force to be transmitted for the same torque at the level of surfaces 55 of the shaft, because it acts with a much greater lever arm. Consequently, there is no fear of the weld between elements 38 and 39 being broken for such a value of the torque to be transmitted. However, if one really wished to take precautions against the risk of the outer anchoring of the spring breaking, one could also use a brake spring of type which is well known for barrels driving the movements of mechanical watches.

If required, another manner of taking precautions against the risk of damage in the situation shown in FIG. 6 might consist in driving shaft 24 only in direction A shown in FIG. 5, owing to a single direction mechanism inserted between oscillating weight 2 and transmission device 5. However, this would involve an increase in the complexity and bulkiness of the mechanism.

The field of application of the present invention is not limited to watches and may extend in particular to all portable apparatus provided with an electric generator, for example portable telephones, measuring apparatus or medical apparatus.

What is claimed is:

1. An anti-shock transmission device for driving the rotor of an electric generator via an oscillating weight in a portable apparatus, including:

a central shaft and an intermediate toothed wheel, one of which is capable of being driven in rotation by movements of the oscillating weight and the other is coupled to the generator rotor by a kinematic connection, said central shaft and said intermediate wheel having a common axis of rotation, a spiral-shaped spring having an inner end coupled to said central shaft and an outer end coupled to said intermediate wheel, wherein said central shaft includes a series of hollows distributed over its periphery and wherein an inner end of said spring is arranged to engage in anyone of said hollows via the resilience of said spring and to be able to be released from said hollow when it is subjected to sufficient force in at least one of the device's rotational directions.

2. The device according to claim 1, wherein each hollow includes a slanting side and wherein said inner end of the spring includes a portion which projects inwards, able to abut against said slanting side to receive said force and to slide over it when said force exceeds a limit value.

3. The device according to claim 2, wherein said projecting portion of the spring is formed by a bent portion having a free end able to abut against said slanting side.

4. The device according to claim 3, wherein said bent portion forms an obtuse angle with an adjacent portion of said spring, an inner face of said angle being arranged to abut against an edge of said hollow.

5. The device according to claim 2, wherein each hollow has, in a perpendicular plane to said shaft, a substantially V-shaped asymmetrical profile whose longest branch forms said slanting side.

6. The device according to claim 1, wherein said central shaft is provided with a pinion coupled by meshing with said oscillating weight and wherein said intermediate wheel is coupled by meshing with said generator rotor.

7. The device according to claim 6, wherein said spring is housed in a barrel including a drum provided with a bottom and a cover, said outer end of the spring being anchored in said drum, and wherein said intermediate wheel is formed by an outer toothing on said drum.

8. The device according to claim 7, wherein said central shaft includes, inside said barrel, an enlarged portion in which said hollows are arranged and including, between the hollows, arcuate bearing surfaces to support said spring.

9. The device according to claim 8, wherein a first inner turn of said spring has, when idle and when said spring is not mounted on said central shaft, a smaller diameter that a diameter defined by said arcuate bearing surfaces.

10. The device according to claim 1, wherein said central shaft is capable of being driven in opposite directions by said oscillating weight.

11. A wristwatch including an electric generator driven by an oscillating weight via an anti-shock transmission device including:

a central shaft and an intermediate toothed wheel, one of which is capable of being driven in rotation by movements of the oscillating weight and the other is coupled to the generator rotor by a kinematic connection, said central shaft and said intermediate wheel having a common axis of rotation, a spiral-shaped spring having an inner end coupled to said central shaft and an outer end coupled to said intermediate wheel, wherein said central shaft includes a series of hollows distributed over its periphery and wherein an inner end of said spring is arranged to engage in anyone of said hollows via the resilience of said spring and to be able to be released from said hollow when it is subjected to sufficient force in at least one of the device's rotational directions.

12. A wristwatch according to claim 11, wherein each hollow includes a slanting side and wherein said inner end of the spring includes a portion which projects inwards, able to abut against said slanting side to receive said force and to slide over it when said force exceeds a limit value.

* * * * *